US005169999A

United States Patent [19]

Jenkins

[11] Patent Number: 5,169,999

[45] Date of Patent: Dec. 8, 1992

[54] RIFLE ACCESSORY

[76] Inventor: Danny W. Jenkins, R. 1, Dixon, Ky. 42409

[21] Appl. No.: 816,744

[22] Filed: Jan. 2, 1992

[51] Int. Cl.[5] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 4,327,515 | 5/1982 | Kuryn | 42/90 |
| 4,407,086 | 10/1983 | Hasselmann | 42/90 |
| 4,875,303 | 10/1989 | DeWeert et al. | 42/90 |
| 5,016,380 | 5/1991 | Jones | 42/90 |
| 5,022,176 | 6/1991 | Frigon et al. | 42/90 |

*Primary Examiner*—Charles T. Jordan
*Attorney, Agent, or Firm*—Warren D. Flackbert

[57] ABSTRACT

A holder for carrying a ball starter on the barrel on a muzzle loading and/or black powder rifle. The holder, secured to the rifle barrel, presents ready access to the ball starter and precludes any previously encountered inconvenience in locating the ball starter on the person of the user or in the general vicinity of use. The holder is conveniently mounted and provision is made for the selective retention of the ball starter thereon, i.e. from release from a stored position to positive placement at such storage position.

3 Claims, 1 Drawing Sheet

RIFLE ACCESSORY

BACKGROUND OF THE INVENTION

As is known, the interest in muzzle loading and/or black powder rifles continues and increases, where the normal loading procedure includes the introduction of the powder into the bore, the compacting of the powder through use of a ramrod, the covering of the compacted powder with a patch, the introduction of a lead ball into the barrel and, finally, the placement of the ball through the use of a starter. The aforesaid ramrod is typically mounted, by a tight fit, on the rifle barrel, being selectively removable from and returnable to the mounted position.

A particular difficulty arises, however, in connection with the ball starter, i.e. an accessory item, which, as stated, urges the ball into a desired loaded location. In this connection, the starter is oftentimes retained and/or stored in the pocket of the user but, during the hunting activity, is susceptible to being lost and/or misplaced.

DESCRIPTION OF THE INVENTION

The invention overcomes the latter difficulty by providing a holder for the ball starter (in which the ramrod may also be positioned), which presents a passageway through which the handle of the ball starter is selectively received. Threaded means typically maintain such handle in a transporting or non-use position.

In any event, the arrangement is such that the ball starter is conveniently positioned proximate the rifle user, presenting positive transporting to a use site and yet, at the same time, is easily removed, and subsequently returned, for and after ball starting.

As should be evident, the invention is simple in form and readily positionable at the desired location on the user's rifle.

DESCRIPTION OF THE FIGURES

A better understanding of the present invention will become more apparent from the following description, taken in conjunction with the accompanying drawing, wherein.

Figure 1:
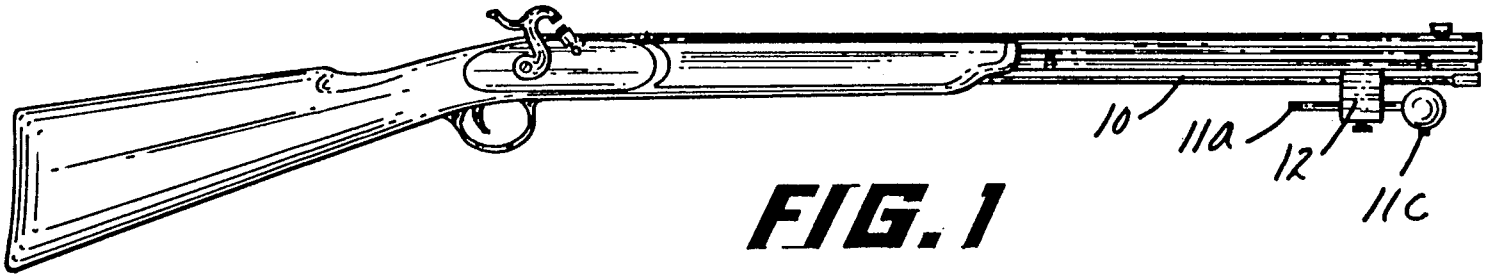
FIG. 1 is a view in side elevation showing an entire rifle including the ball starter holder in accordance with the teachings of the present invention.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the figures, the ball starter holder of the invention is used in connection with a muzzle loading and/or a black powder rifle presenting, typically, a fifty caliber ball size.

In the usual loading procedure for rifle usage, the latter is placed in a vertical position and powder introduced and/or poured into the muzzle. A ramrod 10, generally detachably secured to the outer surface of the rifle barrel, is released and used to pack the powder. The powder is covered by a conventional patch (not shown) followed by the introduction of a lead ball into the powder carrying rifle barrel.

A lead ball starter 11 is then placed into the rifle barrel, where, through pushing action, the ball is retained in position, i.e. is prevented from becoming dislodged prior to firing. The ball starter 11, as stated, was formerly located somewhere on the person of the user.

Figure 2:
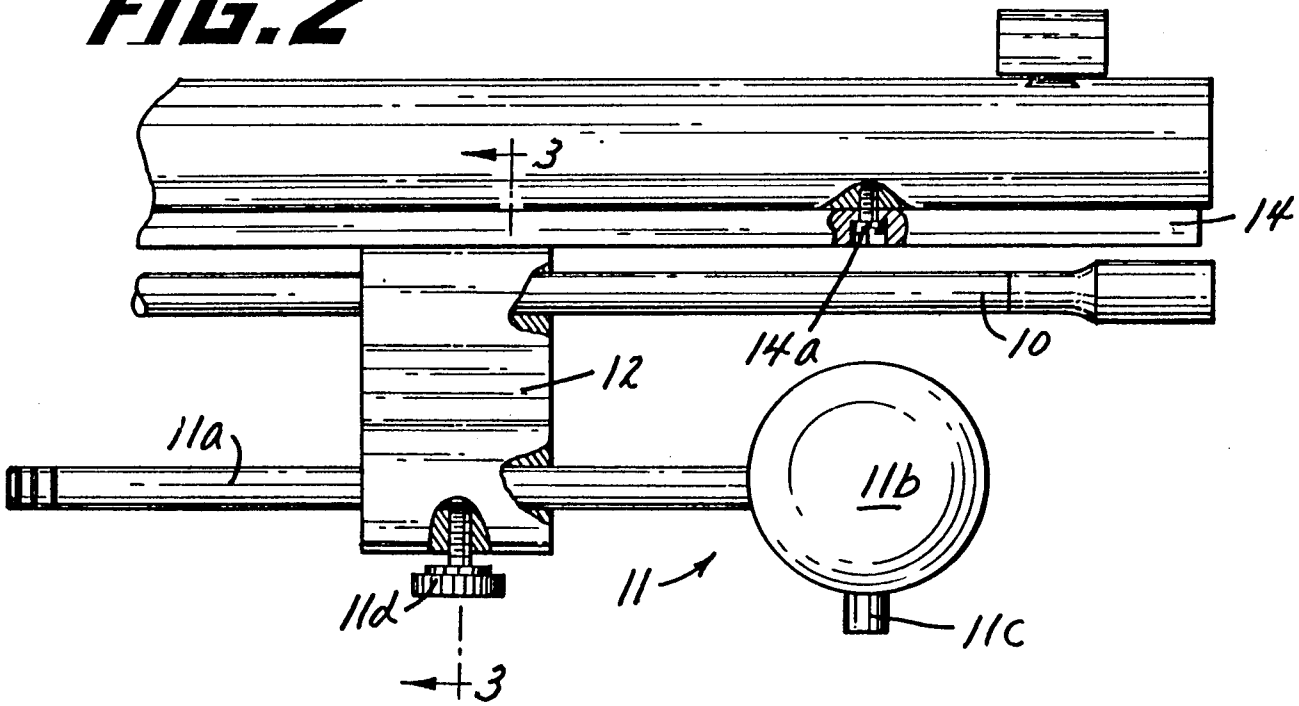
FIG. 2 is an enlarged view of the instant holder, detailing the operative location of such; and, FIG. 3 is a view in vertical section, further detailing the invention, and taken at line 3-3 on FIG. 2 and looking in the direction of the arrows.

The ball starter 11, as shown in FIG. 2, includes an elongated shaft or stem 11*a* mounting, at one end, an enlarged ball 11*b* from which a pusher 11*c* radially extends. The pusher 11*c* is of such diameter as to be received within the powder containing barrel of the rifle.

In any event, importance of the invention lies in holder 12 for the ball starter 11. In this connection, and further referring to FIGS. 2 and 3, the holder 12 is mounted on a longitudinal carrying member 14 which extends beneath the rifle barrel, typically by threaded means 14*a* extending in a securing relationship (see FIG. 2). The holder 12 of the invention is, in turn, mounted on the aforesaid carrying member 14, as by a threaded arrangement 15 (see FIG. 3).

Figure 3:
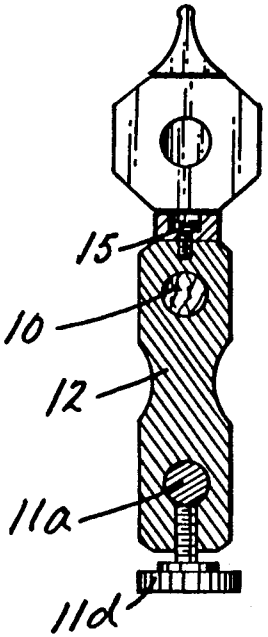

The bottom portion of the instant holder 12 includes a passageway through which the ball starter 11 shaft or handle 11*a* is introduced (see FIGS. 2 and 3).

Also, in this regard, threaded means 11*d* are provided to retain and release the ball starter 11 for, respectively, transporting and use conditions. In other words, the invention presents a convenience factor not heretofore known, i.e. where the ball starter placed in a pocket of a jacket, coat or trouser of the user, could be misplaced by falling to the ground, or just unavailable due to overall conditions at the firing time.

The ball starter holder described hereabove is susceptible to various changes within the spirit of the invention, including, by way of example, in proportioning; the type of material from which the holder is fabricated; the precise arrangement for affixing the holder to the rifle barrel; and, the like. Thus, the preceding should be considered illustrative and not as limiting the scope of the following claims:

I claim:

1. In combination with a rifle having a muzzle which is loaded with powder, a patch and a ball, a holder for a ball starter comprising a body portion selectively secured to said muzzle, said body portion including a fist passageway and a second passageway selectively and respectively receiving said ball starter and a ramrod for compacting said powder.

2. The combination of claim 1 where one of said passageways of said holder selectively receives an elongated support arm for said ball starter and includes a member mounting an extending pusher.

3. The combination of claim 2 where latching means on said holder selectively position said ball starter.

* * * * *